US010529502B2

(12) United States Patent
Lau

(10) Patent No.: US 10,529,502 B2
(45) Date of Patent: Jan. 7, 2020

(54) LOCKABLE TRIGGER MECHANISM FOR USE IN AN ELECTRICAL DEVICE

(71) Applicants: DONGGUAN CHEN DA APPLIANCE CO. LTD, Guangdong (CN); DEFOND COMPONENTS LIMITED, Chai Wan (HK)

(72) Inventor: Ho Cheung Lau, Chai Wan (HK)

(73) Assignees: DEFOND COMPONENTS LIMITED, Chai Wan (HK); DEFOND ELECTECH CO., LTD., Dongguan (CN)

( * ) Notice: Subject to any disclaimer, the term of this patent is extended or adjusted under 35 U.S.C. 154(b) by 0 days.

(21) Appl. No.: 15/712,522

(22) Filed: Sep. 22, 2017

(65) Prior Publication Data

US 2018/0096802 A1 Apr. 5, 2018

(51) Int. Cl.
*H01H 3/20* (2006.01)
*H01H 13/08* (2006.01)
(Continued)

(52) U.S. Cl.
CPC ..... *H01H 3/20* (2013.01); *H01H 13/08* (2013.01); *H01H 13/562* (2013.01); *H01H 9/06* (2013.01); *H01H 9/061* (2013.01)

(58) Field of Classification Search
CPC .... B43K 24/183; B43K 25/028; B43K 21/06; B43K 24/08; B43K 24/084; H01H 13/58;
(Continued)

(56) References Cited

U.S. PATENT DOCUMENTS 3,288,115 A 11/1966 Hechtle
4,095,072 A 6/1978 Piber
(Continued)

FOREIGN PATENT DOCUMENTS

CN 1897200 A 1/2007
CN 201655707 U 11/2010
(Continued)

OTHER PUBLICATIONS

Search Report of priority document No. HK1600652.
Office Action of Chinese Patent Application No. 201710696144.9.

*Primary Examiner* — Ahmed M Saeed
(74) *Attorney, Agent, or Firm* — Joseph G. Chu; JCIP

(57) ABSTRACT

A lockable trigger mechanism for an electrical device, comprising: a housing; a trigger for biased movement relative to the housing; an actuator movably mounted to the housing such that in response to operation of the trigger, the actuator is movable along a movement axis from an OFF position inwardly of the housing towards an ON position, and movable along the movement axis from the ON position in a direction outwardly of the housing towards the OFF position; an electrical switch unit mounted to the housing for activation in response to movement of the actuator along the movement axis between its ON and OFF positions to close and open an electrical circuit of the electrical device respectively; and a locking mechanism comprising a first locking member, a second locking member and a biasing member configured for biasing movement of the first locking member relative to the second locking member.

10 Claims, 7 Drawing Sheets

(51) Int. Cl.
*H01H 13/56* (2006.01)
*H01H 9/06* (2006.01)

(58) Field of Classification Search
CPC .... H01H 13/023; H01H 13/56; H01H 13/585; H01H 13/063; H01H 13/183; H01H 1/36; H01H 2003/085; H01H 3/42; H01H 9/226
USPC ..... 200/527, 526, 314, 565, 11 G, 14, 275, 200/276.1, 303, 336, 341, 523, 528, 529, 200/11 A, 11 DA, 11 R, 17 R, 253, 273, 200/283, 284, 292, 296, 316, 323, 4, 406, 200/437, 5 R, 533, 536, 564, 570, 6 R, 200/61.45 R, 61.53
See application file for complete search history.

(56) References Cited

U.S. PATENT DOCUMENTS

| | | | | |
|---|---|---|---|---|
| 4,319,106 | A * | 3/1982 | Armitage ..... | H01H 13/58 200/526 |
| 5,177,466 | A | 1/1993 | Lai | |
| 2013/0058711 | A1* | 3/2013 | Van Der Linde ..... | H01R 13/72 403/349 |
| 2015/0213975 | A1* | 7/2015 | Zheng ..... | H01H 13/83 200/5 A |

FOREIGN PATENT DOCUMENTS

| | | | |
|---|---|---|---|
| CN | 104321845 | A | 1/2015 |
| EP | 2869324 | A1 | 5/2015 |
| WO | WO09963188 | A3 | 2/2000 |

* cited by examiner

LOCKABLE TRIGGER MECHANISM FOR USE IN AN ELECTRICAL DEVICE

This application claims priority to Hong Kong Patent Application No. 16111468.2 filed on Sep. 30, 2016, the content of which is incorporated by reference in its entirety.

TECHNICAL FIELD

The present invention relates to lockable trigger mechanisms for use in electrical devices such as a power tools, gardening tools and the like.

BACKGROUND OF THE INVENTION

It is sometimes required that a trigger-operated electrical device, such as a power tool, be continuously operated for an extended period of time at a desired speed setting. To alleviate fatigue in the user's finger operating the trigger, a locking mechanism may be provided to allow locking of the power tool at the desired speed of operation. Certain conventional trigger mechanisms may include a latch member disposed on the side of the trigger mechanism housing which must be manually moved with some degree of force into a locking position by one of the user's hands to effect locking of the trigger mechanism in to the desired speed setting. This is not only slow and tedious to lock the trigger mechanism into the desired speed setting, but is also slow and tedious to thereafter dislodge the latch member from its locked position. Furthermore such conventional locking systems may also compromise user safety as the user is required to use both hands to effect locking of the power tool. That is, one hand (usually the hand that is used to firmly grip/support the body of the power tool) is required to manually move the latch member disposed on the trigger housing with some force into its locked position whilst the other hand is required to squeeze the trigger at the desired speed setting. Other conventional locking systems may require the latch member to be moved in multiple orientations, for instance, by manually moving the latch member inwardly and then upwardly of the trigger housing. Again, these conventional locking mechanisms require two hands to be operated and risk of injury to the user is further exacerbated due to the awkward and unnatural movements required by one of the user's hand in manually moving the latch member in to the locked position.

SUMMARY OF THE INVENTION

The present invention seeks to alleviate at least one of the above-described problems.

The present invention may involve several broad forms. Embodiments of the present invention may include one or any combination of the different broad forms herein described.

In a first broad form, the present invention provides a lockable trigger mechanism for an electrical device, comprising: a housing; a trigger configured for biased movement relative to the housing; an actuator movably mounted to the housing such that, responsive to operation of the trigger, is movable along a movement axis from an OFF position in a direction relatively inwardly of an opening in the housing towards an ON position, and movable along the movement axis from the ON position in a direction relatively outwardly of the opening in the housing towards the OFF position; an electrical switch unit mounted to the housing configured for activation in response to movement of the actuator along the movement axis between its ON and OFF positions to close and open an electrical circuit of the electrical device respectively; and a locking mechanism comprising a first locking member, a second locking member and a biasing member configured for biasing movement of the first locking member relative to the second locking member; wherein, responsive to the actuator being moved in a direction inwardly of the housing along the movement axis from its OFF position into its ON position, the first locking member is moved relative to the second locking member into engagement with a first shape contour of said second locking member and said first locking member is held in engagement with the first shape contour of said second locking member by the biasing member urging the first and second locking members together whereby the engagement of the first locking member with the first shape contour of the second locking member is configured to restrict movement of the actuator in a direction outwardly of the housing along the movement axis from the ON position to its OFF position, and thereafter, responsive to the actuator being moved further in a direction inwardly of the housing along the movement axis, the first locking member is moved out of engagement with the first shape contour of the second locking member and along a second shape contour of the second locking member whereby the movement of the first locking member along the second shape contour of the second locking member is configured to allow the actuator to be urged in a direction outwardly of the housing along the movement axis in to its OFF position.

Preferably, the biasing member may include an elastic member.

Preferably, the elastic member may include a coil spring.

Preferably, the biasing member of the locking mechanism may be configured for movement in substantially a same direction as the biasing member of the actuator.

Preferably, the biasing member of the locking member may be configured to function a dual-purpose as the biasing member of the actuator.

Preferably, the biasing member of the locking member may include a return spring of the actuator.

Preferably, the first locking member may be disposed on an inner surface of the housing and the second locking member is disposed on the actuator.

Preferably, the first locking member may include a track and the second locking member may include a guide pin configured for slidable movement along the track.

Preferably, the actuator may be configured to move along a linear axis inwardly and outwardly of the housing via the opening between the ON and OFF positions.

Preferably, the present invention may include a variable speed control unit configured for controlling operation of the electrical device at a plurality of speeds, each of said plurality of speeds being controlled by reference to one of a plurality of corresponding positions of the actuator relative to the housing. Preferably, when the actuator is moved in a direction inwardly of the housing along the movement axis from its OFF position into its ON position and the first locking member is moved relative to the second locking member into engagement with the first shape contour of said second locking member, the electrical device is configured to operate at a maximum speed of a plurality of possible operational speeds of the electrical device. Alternately, when the actuator is moved in a direction inwardly of the housing along the movement axis from its OFF position into its ON position and the first locking member is moved relative to the second locking member into engagement with the first shape contour of said second locking member, the ON position may correspond to any one of a plurality of possible operational speeds of the electrical device.

Preferably, the electrical device may include at least one of a power tool and a gardening tool.

A lockable trigger mechanism for an electrical device, comprising: a housing; a trigger configured for biased movement relative to the housing; an actuator movably mounted to the housing so as to be movable along a movement axis from an OFF position in a direction relatively inwardly of the housing towards an ON position, and movable along the movement axis from the ON position in a direction relatively outwardly of the opening in the housing towards the OFF position, said actuator including a biasing member configured for biasing the actuator towards the OFF position; an electrical switch unit mounted to the housing configured for activation in response to movement of the actuation member along the movement axis between its ON and OFF positions to close and open an electrical circuit of the electrical device respectively; and a locking mechanism comprising a ballpoint pen type protract-retract mechanism configured for alternately retracting the actuator in to the ON position in response to a first movement of the trigger relatively inwardly of the housing, and thereafter, protracting the actuator in to the OFF position in response to a further movement of the trigger relatively inwardly of the housing.

Typically, the ballpoint pen type protract-retract mechanism may comprise a plunger terminating in a set of teeth, a ratchet operably connected to the actuator, said ratchet having a set of main teeth, and a set of teeth disposed on an inner surface of the housing configured for alternately engaging and turning the main teeth of the ratchet to permit entry of the main teeth of the ratchet into slots disposed on the inner surface of the housing and for retaining the ratchet in the retracted position.

Typically, the ratchet may further include an inwardly positioned set of auxiliary teeth for contact with the plunger teeth when the plunger engages the ratchet.

In a further broad form, the present invention provides an electrical device including a lockable trigger mechanism in accordance with any one of the broad forms of the present invention described herein.

Preferably the electrical device may include at least one of a power tool and a gardening tool.

BRIEF DESCRIPTION OF THE DRAWINGS

The present invention will become more fully understood from the following detailed description of a preferred but non-limiting embodiments thereof, described in connection with the accompanying drawings, wherein.

DETAILED DESCRIPTION OF THE PREFERRED EMBODIMENTS

Preferred embodiments of the present invention will now be described herein with reference to FIGS. 1 to 9. The embodiments comprise a variable-speed trigger mechanism of an electric power tool having a novel locking mechanism for automatically locking the trigger mechanism at a desired speed setting so that the power tool may continue operating at that speed setting without requiring the user's finger to continue holding the trigger in the speed setting position. The power tool may include for instance an electric drill, grinder, sander, saw, rotary driving tool and the like. It would be appreciated and understood that whilst this embodiment is described for use in locking a variable-speed trigger mechanism of an electric power tool, this is merely for ease of illustrating functionality and alternate embodiments of the present invention may of course be used for locking both single-speed as well as variable-speed trigger mechanisms for use in any other type of electrical devices such as gardening tool.

Figure 1:
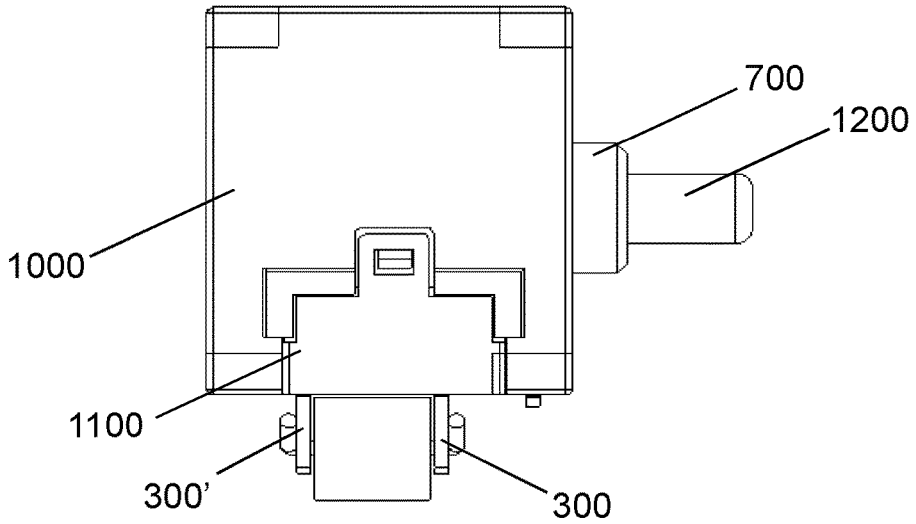
FIG. 1 shows a first side view of a first embodiment of the present invention with the actuator slid outwardly of an opening in a trigger mechanism housing along a movement axis in to an OFF position.
Figure 2:
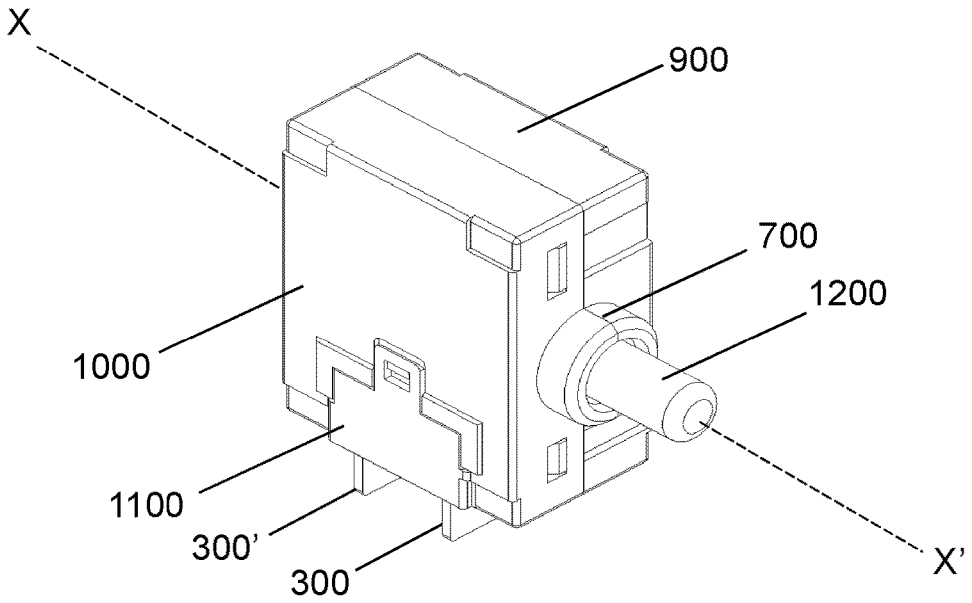
FIG. 2 shows a perspective view of the first embodiment of the present invention with the actuator slid outwardly of an opening in the trigger mechanism housing along a movement axis in to an OFF position.
Figure 3:
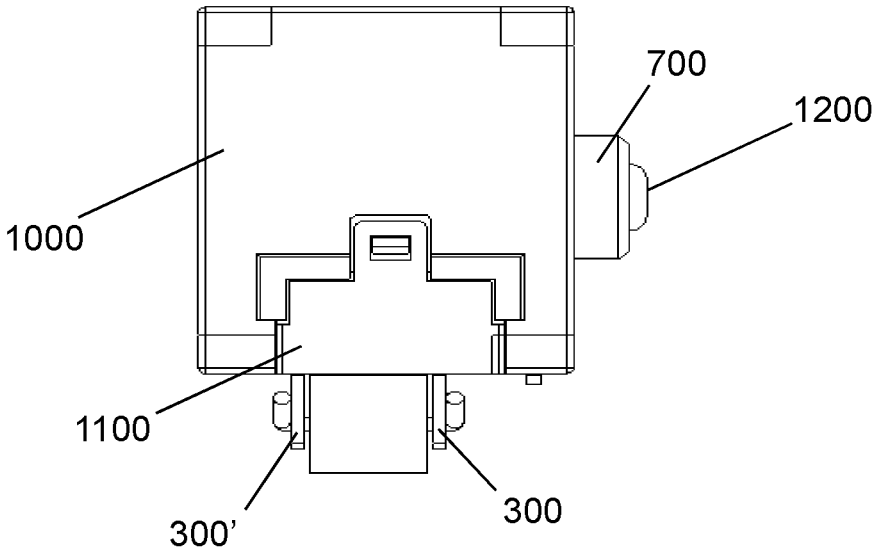
FIG. 3 shows a first side view of a first embodiment of the present invention with the actuator slid inwardly of the opening in the trigger mechanism housing along a movement axis in to an ON position.
Figure 4:
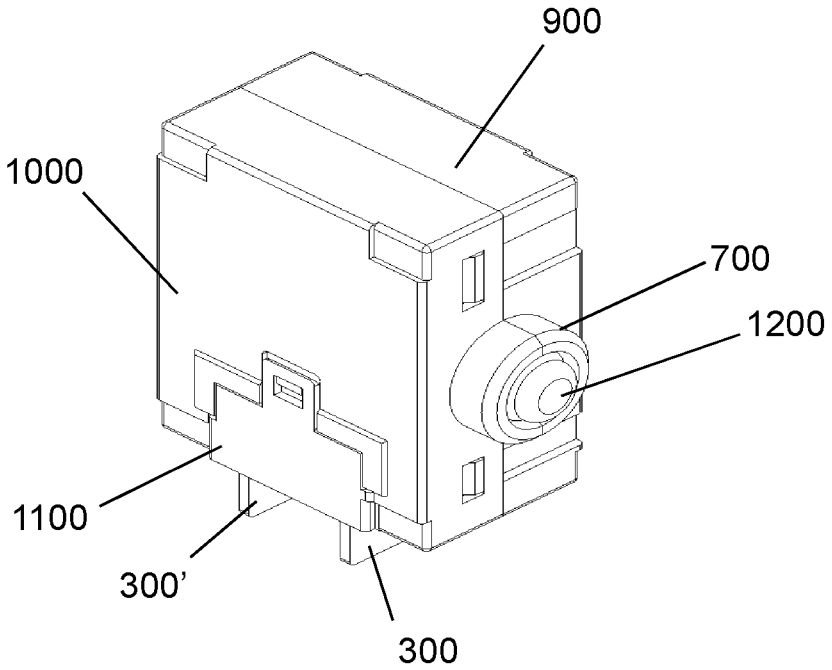
FIG. 4 shows a perspective view of the first embodiment of the present invention with the actuator slid inwardly of the opening in the trigger mechanism housing along a movement axis in to an ON position.
Figure 5:
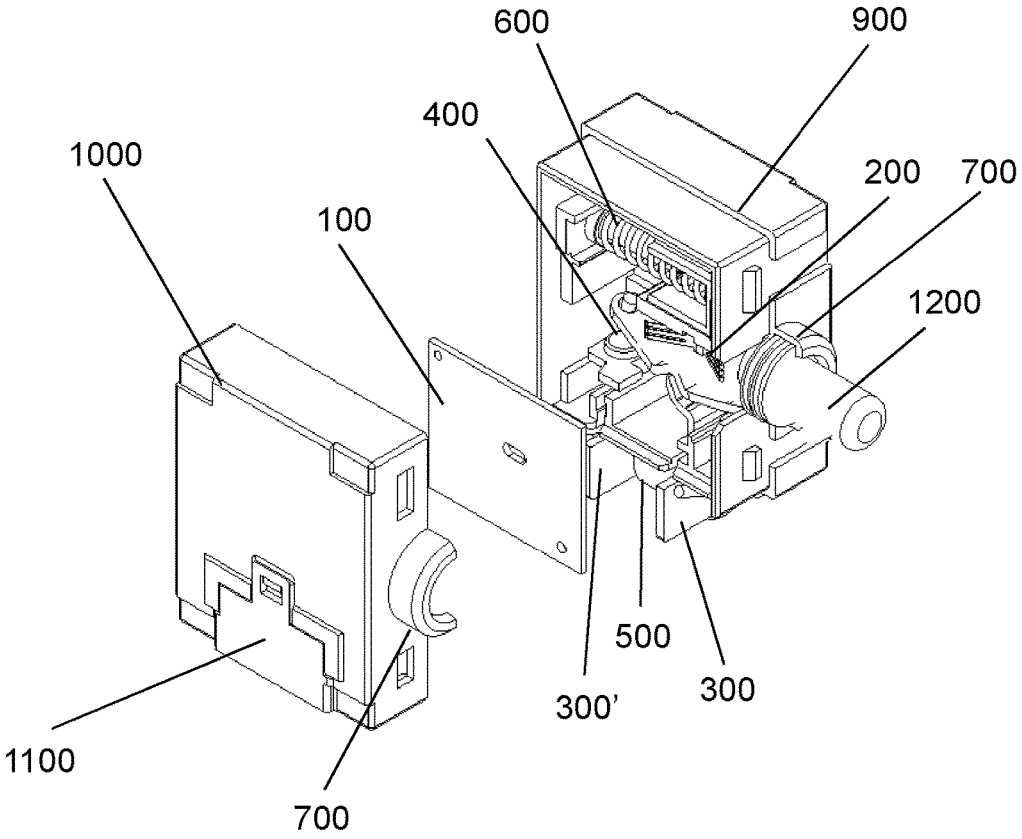
FIG. 5 shows a perspective partial exploded view of the first embodiment of the present invention with the actuator slid outwardly of the opening of the trigger mechanism housing along a movement axis in to an OFF position.
Figure 6:
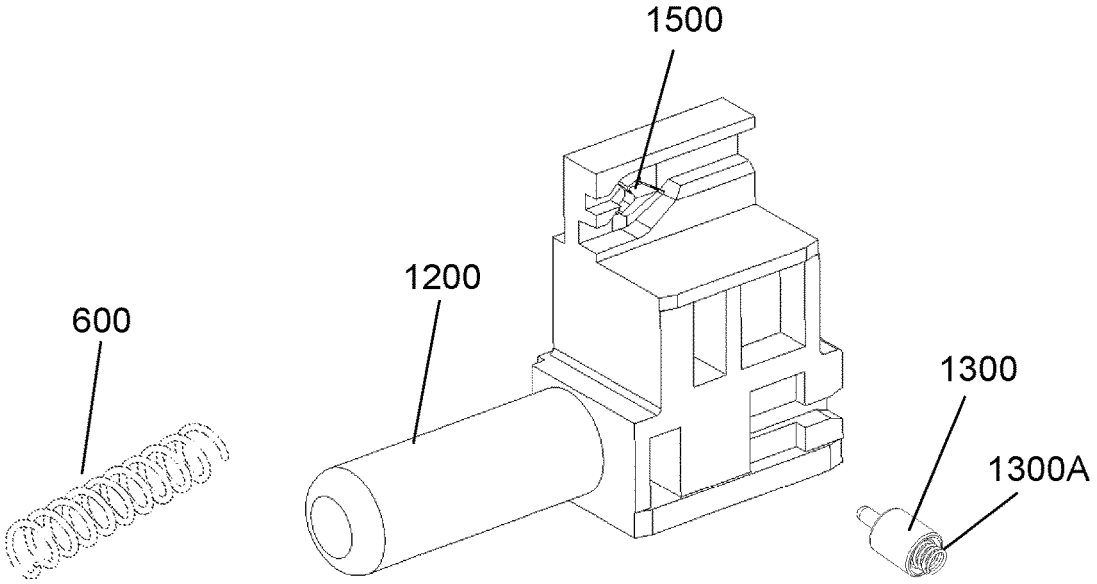
FIG. 6 shows a perspective view of the actuator (with track disposed thereon), a return spring and a guide pin of the first embodiment of the present invention.

Referring to FIGS. 1 and 2, the variable-speed trigger mechanism includes a moulded plastic housing (900, 1000) that is mounted to a body of the electric power tool near to a handle of the electric power tool. The housing (900, 1000) includes a first housing member (900) and a second housing member (1000) that may be snap-fitted or screwed together to substantially enclose the trigger mechanism and locking mechanism therebetween. The variable-speed trigger mechanism includes a finger-operable trigger having an actuator (1200) configured for slidable linear movement relative to the housing (900, 1000) along a movement axis (X,X') relatively inwardly of an opening in the housing (900, 1000) from an OFF position towards an ON position, and, relatively outwardly of the opening in the housing (900, 1000) from the ON position toward the OFF position. A sealing ring (700) is located at the opening of the housing (900, 1000) to provide a seal between the opening and the actuator (1200) which may alleviate ingress of dust and other particles into the housing (900, 1000) via the opening. A return spring (600) is mounted inside the housing (900, 1000) which bears upon an inner surface of the housing (900, 1000) to urge the actuator (1200) towards the OFF position by default.

An electrical cord (not shown) is coupled to the housing (900, 1000) adjacent the cable cover (1100) and is also electrically coupled to an electric motor (not shown) of the electric power tool (not shown) so as to be able to provide electrical power for driving the electric motor. While the embodiment described herein includes an electrical cord, other embodiments of the present invention may be cordless and configured to be driven by a lithium ion battery, a ni-cad battery, or the like.

Figures 7A, 7B, 7C:
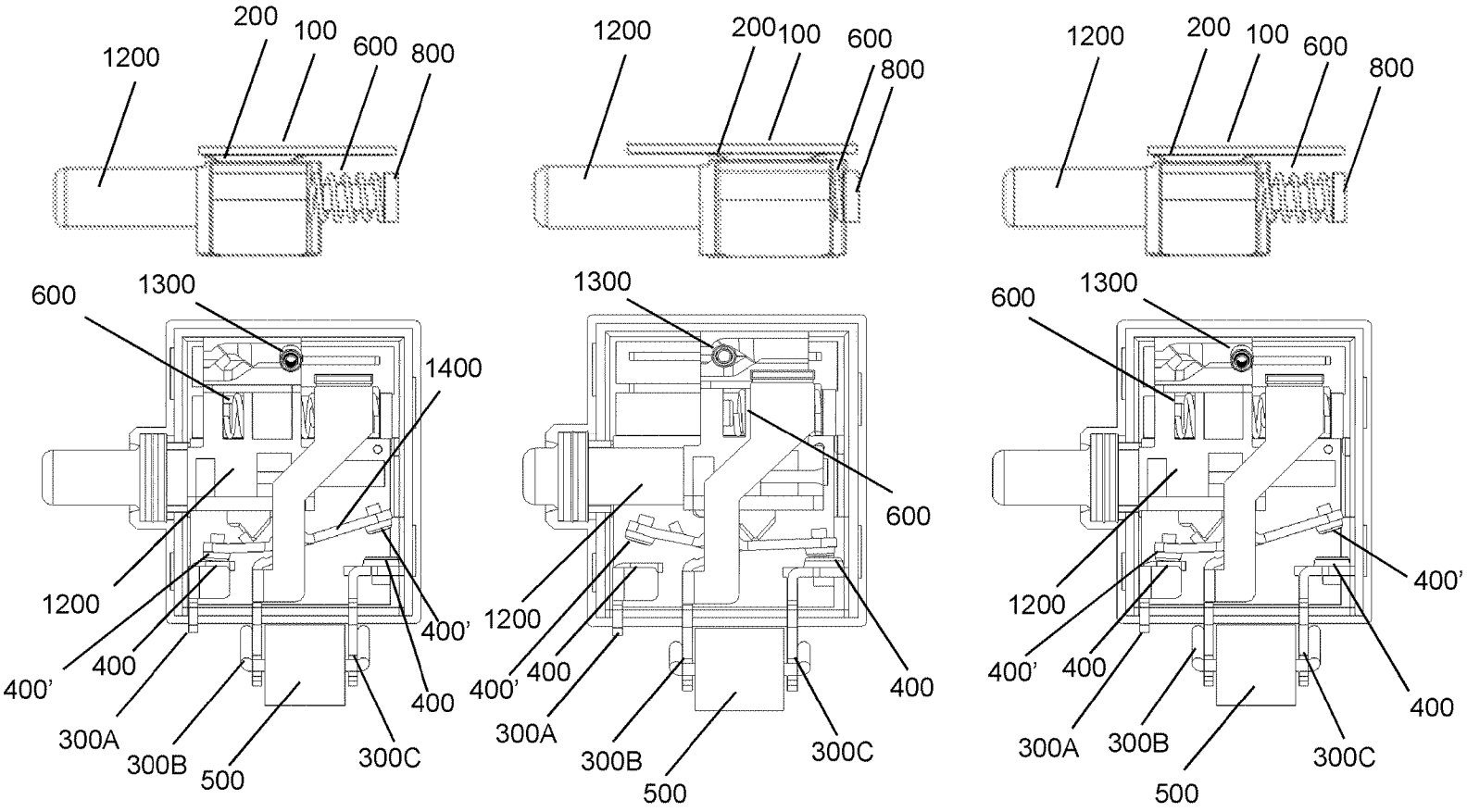
FIG. 7A shows a transparent reverse side view of the first embodiment of the present invention with the actuator slid outwardly of the opening in the trigger mechanism housing along a movement axis in to an OFF position.
FIG. 7B shows a transparent reverse side view of the first embodiment of the present invention with the actuator slid inwardly of the opening in the trigger mechanism housing along a movement axis in to an ON position whereby the guide pin is urged into engagement with a first shape contour of the track and is held in engagement to restrict movement of the actuator outwardly of the opening in the trigger mechanism housing along the movement axis.
FIG. 7C shows a second transparent side view of the first embodiment of the present invention shown in FIG. 7B after the actuator has been further slid inwardly of the housing along the movement axis so that the guide pin is moved out of engagement with the first shape contour of the track and along a second shape contour of the track to allow the actuator to be urged in a direction outwardly of the opening in the trigger mechanism housing along the movement axis in to its OFF position.

As depicted most clearly in the transparent side-views of FIGS. 7A-7C, two pairs of electrical contacts (400-400', 400-400') are located inside of the housing (900, 1000) which define two electrical switches that are operable in response to movement of the actuator (1200) between the ON and OFF positions for closing and opening individual electrical circuits. The electric motor is driven by the power supply arranged in series in a first electrical circuit when the first electrical switch is arranged in a closed state responsive to movement of the actuator (1200) inwardly of the housing (900, 1000). An auxiliary electrical element such as a power-on indicator LED (500) is also driven by the power supply arranged in series in a second electrical circuit when the second electrical switch is arranged in a closed state responsive to movement of the actuator (1200). Two of the electrical contacts (400, 400) are disposed on the ends of the fixed electrical terminals (300A, 300C) that are rigidly secured within the housing (900, 1000) whilst two of the electrical contacts (400', 400') are disposed on the ends of a contact lever (1400) that is pivotably mounted to a common fixed electrical terminal (300B) which acts as a fulcrum for the contact lever (1400) mounted thereon. The contact lever (1400) is configured to pivotably move in response to slidable movement of the actuator (1200) along the movement axis so that each contact pair (400-400', 400-400') are either in contact with each other in the ON state or out of contact with each other in the OFF state. All of the electrical contacts (400-400', 400-400') are formed from a copper alloy material with or without plating which may ensure good electrical contact after repeated operation of the electrical switches and alleviates sparking.

The variable-speed trigger mechanism includes a variable-speed control mechanism for controlling the amount of power delivered to the electric motor from the power supply and hence the speed of the motor, in response to movement of the trigger by the user's finger. In this embodiment, the power tool may by way of example have 4 speed settings which correspond to different relative positions of the actuator as it is slidably moved inwardly of the housing (900, 1000) along the movement axis (X,X'). As the trigger is squeezed and the actuator (1200) is gradually moved inwardly of the housing (900, 1000) along the movement axis (X,X'), the speed of the power tool may incrementally increase from speed setting 1 (OFF) through to speed setting 4 (ranging for instance from 0 rpm through to 2,000 rpm). Each of the speed settings from 1 through to 4 may be incrementally increased as the user squeezes the trigger and the actuator (1200) moves increasingly relatively inwardly of the housing (900, 1000) to certain threshold distances corresponding to each of the speed settings.

In this embodiment, the variable-speed control mechanism may include a potentiometer, a timing signal generator and a solid state device that are operably-connected together so as to control the amount of power delivered to the motor from the power supply and hence the speed of the motor in operation, in response to the extent to which the trigger is squeezed by the user's finger. A PCB (100) is mounted within the housing adjacent the actuator (1200) and includes the timing signal generator and solid state device circuitry thereon. The potentiometer includes a conductive wiper (200) which is mounted to the actuator (1200) so as to move linearly along the movement axis (X,X') relative to conductive pads of the potentiometer disposed on a PCB (100). In use, the conductive wiper (200) is configured to have current running therethrough such that the potentiometer will output a variable voltage signal in response to the position of the wiper (200) relative to the conductive pads. The timing signal generator (e.g. a "555" circuit) is communicably coupled with the output of the potentiometer and is configured to sense the variable voltage signal of the potentiometer. The movement of the conductive wiper (200) relative to the conductive pads gradually reduces the resistance of the potentiometer from a relative high resistance towards a relatively low resistance, and the variable voltage signal sent to the timing signal generator will vary accordingly. The output of the timing signal generator is coupled to an input gate of a solid state device, such as a MOSFET, whereby in response to the received timing signal, the MOSFET is configured to be switched on and off at timing intervals corresponding to the timing signal generator output to appropriately control the amount of power that is delivered from the power supply to the electric motor corresponding to the conductive wiper (200) position (and hence speed setting).

The locking mechanism of this embodiment is integrally formed inside of the trigger mechanism housing (900, 1000) and allows the actuator (1200) to be automatically locked after the actuator (1200) has been slidably moved relatively inwardly of the housing (900, 1000) along the movement axis (X,X') into the desired speed setting position. This obviates the need for the user to manually lock the actuator (1200) into position and does not require the user to continue to manually holding the trigger in position to maintain continued operation of the power tool at the desired speed setting. In use, as the actuator (1200) is initially moved relatively inwardly of the opening in the housing (900, 1000) from its default OFF position along the movement axis to a desired ON speed setting, the locking mechanism will function to releasably lock the actuator (1200) into its speed setting position such that the actuator (1200) is restricted from being moved in a direction relatively outwardly of the opening in the housing (900, 1000) along the movement axis (X,X') . The power tool will continue to operate at the speed setting to which it is automatically locked without requiring the user's finger to continue manually operating the trigger. Thereafter, by further squeezing the trigger and causing the actuator (1200) to move further in a direction relatively inwardly of the opening in the housing (900, 1000) along the movement axis, the actuator (1200) may be easily and conveniently unlocked from its speed setting and allowed to slide again in a direction relatively outwardly of the housing (900, 1000) along the movement axis (X,X') towards its default OFF position.

Figure 8:
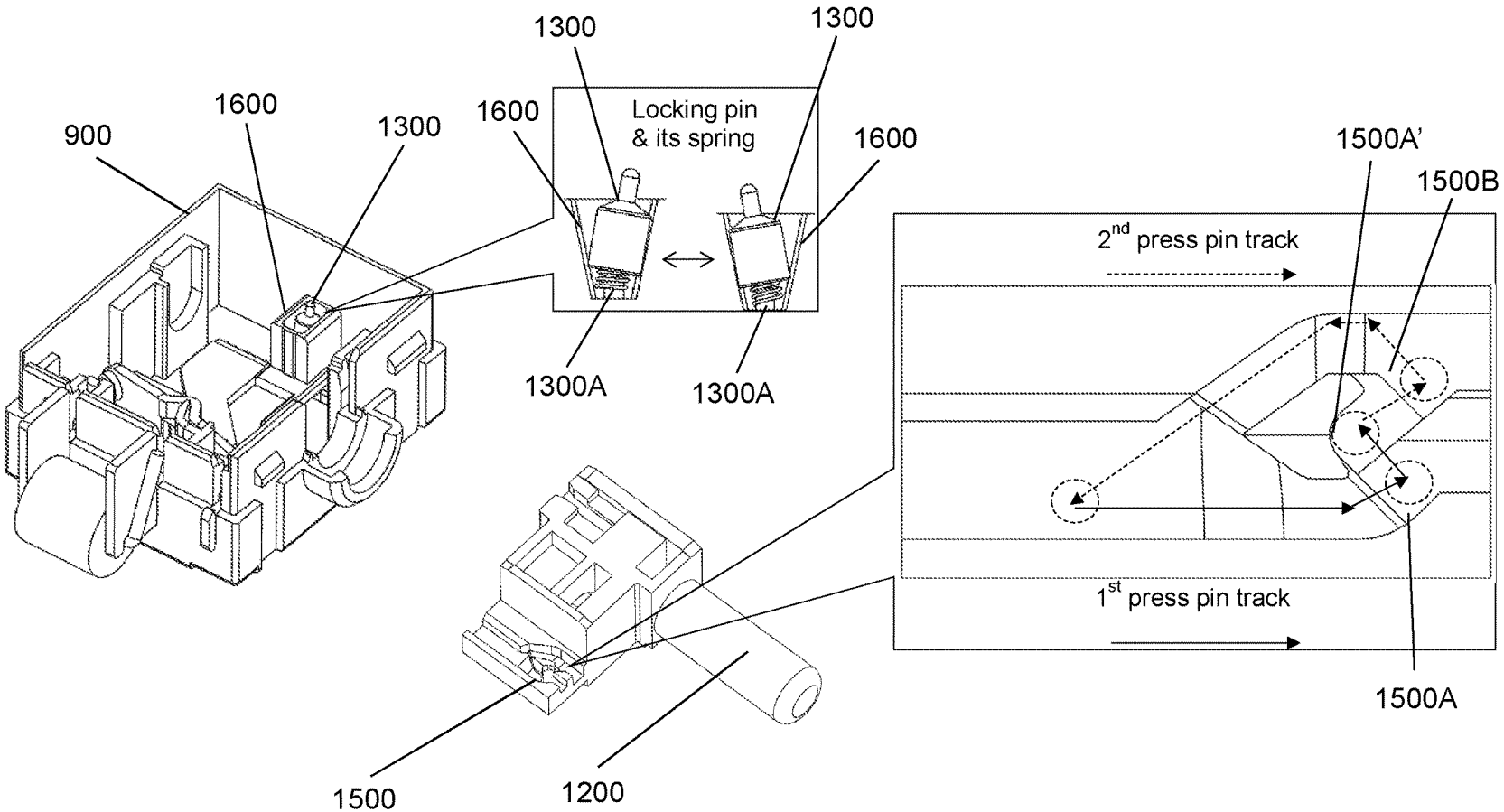
FIG. 8 shows magnified views of the guide pin seated within the housing and the track moulded into the actuator.

In this embodiment, the locking mechanism comprises a first locking member in the form of a guide pin (1300), a second locking member in the form of a track (1500), and a biasing member (600) in the form of a coil spring (600) configured for urging movement of the guide pin against shape contours of the track (1500) as it is moved along the track (1500). Also in this embodiment, as shown in FIG. 8, the guide pin (1300) is mounted within a seating portion (1600) disposed in an inner surface of the first housing member (900) whilst the track (1500) is moulded in to a surface of the actuator (1200) so as to be slidably movable with the actuator (1200) as the actuator (1200) slidably moves inwardly and outwardly of the housing (900, 1000) along the movement axis (X,X'). The track (1500) is also configured for receiving the guide pin (1300) so that the guide pin (1200) may slide along the track (1500) during movement of the actuator (1200). The guide pin (1300) is spring loaded by a spring member (1300A) and is also able to swivel about within the seating portion (1600) of the first housing member (900) in which it is seated. In this embodiment, the biasing member (600) of the locking mechanism is provided by the return spring (600) of the actuator (1200) which serves a dual-functional purpose. It is of course possible for the locking mechanism to include its own independent biasing member in alternate embodiments whereby the biasing member of the locking mechanism and the return spring of the actuator (1200) would be configured to expand and contract substantially in a same direction. However the shared use of the actuator (1200) return spring (600) also as the biasing member of the locking mechanism may assist in providing a more compact and simplified trigger and locking mechanism as well as reduced complexity and costs of manufacturing.

In response to the actuator (1200) being moved in a direction relatively inwardly of the opening in the housing (900, 1000) along the movement axis (X,X') from its OFF position (as shown in FIG. 7A) into a desired ON speed setting (as shown in FIG. 7B), the guide pin (1300) mounted on the housing (900, 1000) is configured to slide within the track (1500) and into engagement with a first shape contour (1500A) of the track (1500). The guide pin (1300) is configured to be held in engagement with the first shape contour (1500A) of the track (1500) as shown in FIG. 8 by the biasing member (600) urging the guide pin (1300) and track (1500) together whereby the engagement of the guide pin (1300) with the first shape contour (1500A) of the track (1500) is configured to restrict movement of the actuator (1200) in a direction relatively outwardly of the opening in the housing (9, 10) along the movement axis (X,X') from the ON speed setting towards the OFF position. As shown in the magnified view of the track in FIG. 8, the guide pin (1300) would be urged in to engagement and held at region (1500A') on the first shape contour (1500A) of the track by virtue of the biasing member (600) being naturally configured to urge the guide pin (1300) and track (1500) together. Thereafter, responsive to the actuator (1200) being moved further in a direction relatively inwardly of the opening in the housing (900, 1000) along the movement axis (X,X'), the guide pin (1300) is configured to slide within the track (1500) out of engagement with the first shape contour (1500A) of the track (1500) and along a second shape contour (1500B) of the track (1500) as shown in FIG. 8 whereby the movement of the guide pin (1300) along the second shape contour (1500B) of the track (1500) is configured to allow the actuator (1200) to be urged in a direction outwardly of the housing (900, 1000) along the movement axis (X,X') in to its OFF position (as shown in FIG. 7C). Advantageously, it can be seen that the locking mechanism provides an automatic mechanism for locating the track (1500) and guide pin (1300) relative to each other to restrict movement of the actuator (1200) when in the desired ON speed setting, and, the biasing member (600) assists in automatically holding the guide pin (1300) against the first shape contour (1500A) of the track (1500) thereby restricting movement of the actuator (1200) in a direction relatively outwardly of the opening in the housing (900, 1000) without requiring any manual actuation by the user to lock the power tool in to the speed setting. The power tool will also continue to operate at the desired speed setting to which it is automatically locked by the locking mechanism without requiring the user's finger to continue operating trigger. The automatic locking mechanism of this embodiment may also allow the power tool to be locked one-handedly if required by simply squeezing the trigger to lock and squeezing the trigger to unlock the power tool from a given speed setting.

For illustrative purposes only, the example track (1500) configuration shown in FIG. 8 only shows a first shape contour (1500A) and a second shape contour (1500B) for locking the guide pin (1300) into one ON speed setting. In this embodiment, the position of the first shape contour (1500A) along the track (1500) is such that when the tip of the guide pin (1300) is held at region (1500A') of the first shape contour (1500) to restrict movement of the actuator (1200) in a direction relatively outwardly of the opening in the housing (9, 10), the actuator (1200) is positioned relative to the housing (900, 1000) whereby the electric power tool is operating at a maximum speed setting. The trigger will typically be fully squeezed inwardly of the housing (900, 1000) when the electrical power tool is operating in its maximum speed setting. It would be understood by a person skilled in the art that in alternate embodiments, the track (1500) may be configured to include additional shape contours to which the guide pin (1300) may engage with as it slides along the track (1500) in order to allow locking of the power tool at more than one speed setting—for instance, being lockable in the maximum speed setting, a minimum speed setting and an intermediate speed setting. The plurality of shape contours may for instance take the form of a series of "stepped" shape contour regions positioned along the track (1500) against which the tip of the guide pin (1300) may be incrementally engaged with and held in engagement with to lock the power tool into each of the corresponding speed settings, as the actuator is moved gradually inwardly of the housing (900, 1000).

It would be appreciated that in alternate embodiments, the arrangement of the guide pin (1300) and the track (1500) may be reversed such that the guide pin (1300) may instead be mounted on the actuator (1200) whilst the track (1500) may be disposed on the first housing member (900).

In a further embodiment of the present invention, the trigger mechanism may comprise a locking mechanism having a protract-retract type mechanism similar to that used in a ballpoint pen for push-to-retract/push-to-protract operation of the ink cartridge relative to the pen barrel. The protract-to-retract type mechanism may be configured to alternately retract and lock the actuator in to the ON position in response to a first movement of the trigger relatively inwardly of the housing, and thereafter, protract and lock the actuator in to the OFF position in response to a further movement of the trigger relatively inwardly of the housing.

Figure 9:
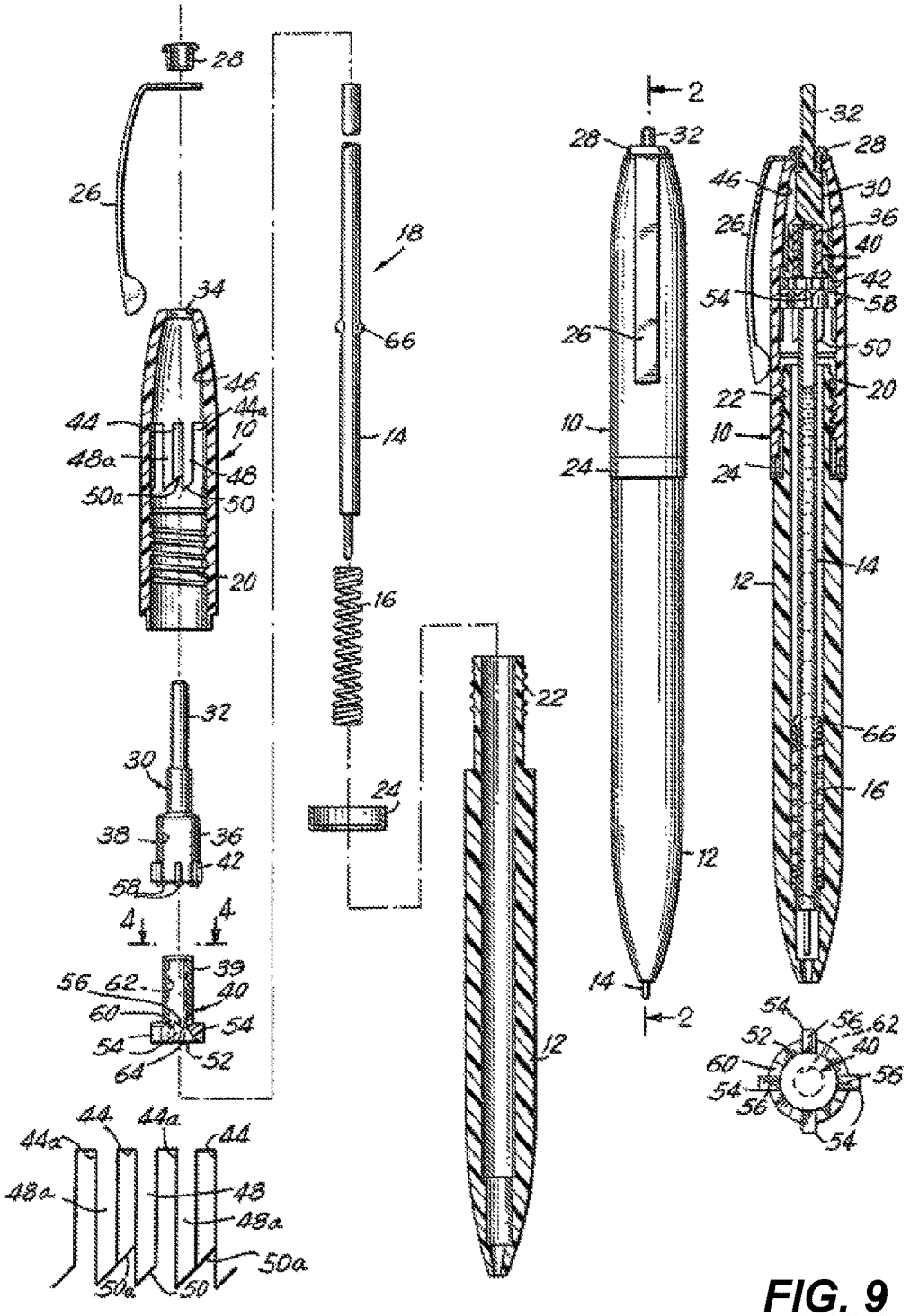
FIG. 9 shows various aspects of an exemplary known ballpoint pen type protract-retract mechanism which may be configured for use in automatically locking the actuator of the power tool in ON and OFF positions responsive to movement of a trigger.

One example of a ballpoint pen type protract-retract mechanism which may suitably configured for use in the locking mechanism of this embodiment is as described in U.S. Pat. No. 3,288,155 the content of which is herein incorporated by reference and selectively reproduced as follows for the purpose of illustrating principle of operation. The pen shown in FIG. 9 comprises a cap (10), and a barrel (12), a cartridge (14), a retract spring (16), and a protract-retract type mechanism (18) for operating the cartridge. The pen cap and barrel (12) may be threaded as at (20) and (22) respectively for securing the parts in position. A band (24) is sometimes used to secure better alignment between the cap and barrel. The cap is preferably provided with a clip (26) which in the pen illustrated is secured to the cap by a hollow rivet (28). The protract-retract mechanism (18) comprises in part, a plunger (30) terminating in an exposed push button (32) at one end, projecting through the opening (34) of the cap, and in a hub (36), made hollow as at (38), to receive the stem (39) of ratchet (40). The plunger (30) is preferably formed with eight laterally extending guides (42), which are adapted to slide in slots (44) and (44*a*) formed on the inner wall (46) of cap (10). The slots are positioned between rails (48) and (48*a*) terminating in tapered teeth (50) and (50*a*) respectively. The guides (42) of plunger (30) are always positioned in the slots (44) and (44*a*) providing a longitudinal non-rotative movement of the plunger in cap. In the form illustrated, slots (48) are less deep than slots (48*a*) although the slots may be of equal depth. The ratchet (40) is provided with a hub (52) from which laterally extends four guides (54) each provided with a main tapered tooth (56) on the upper face thereof to engage the tapered teeth (50) and (50*a*) of the rails (48) and (48*a*) on the inner surface of the cap (10). The lower edge of the plunger (30) terminates in eight teeth (58), which also engage the tapered teeth (56) on the four guides (54) of ratchet (40). By providing the upper edge of the hub (52) with an auxiliary set of eight circularly arranged tapered teeth (60), for engaging the eight teeth (58) formed on the bottom edge of the hub (36) of plunger (30). Thus when ratchet (40) is inserted into the bore (38) of plunger (30), the tapered teeth (58) of the plunger (30) and the tapered teeth (60) of the ratchet (40) are configured to engage each other and align the parts as is shown in FIG. 9 preventing the sharp edges of tapered teeth (56) from cutting into the plunger and jamming the mechanism, preventing rotation of the ratchet. The design of the teeth of the plunger (30), ratchet (40) and cap (10), causes the ratchet (40) to rotate slightly when released from the cap (10), and again when the ratchet teeth engage the cap (10). The ratchet teeth alternately move from the protracted position on teeth (50*a*) into the retracted position when the ratchet teeth engage cap teeth (50) and slide into slot (44*a*). From either position, the plunger (30) when again pressed, will free the ratchet (40) from the cap (10), allowing the ratchet (40) to rotate slightly until the teeth lock, and then when deposited once more on the cap (10) to rotate slightly again until caught in the protract position or the retract position, depending on the position of the ratchet guides with respect to the cap slots. Thus the ratchet (40) rotates slightly when depressed by the plunger (30), and again on the cap teeth when the plunger (30) is withdrawn, causing a circular movement that permits the cartridge to be alternately protracted and retracted. The spring (16) operating on ears (66) of the cartridge (14), forces the cartridge (14) continuously against the ratchet in bore (62), the bevelled seat (64) being provided in the bottom of the ratchet for facility in inserting the end of the cartridge. The stem (39) of the ratchet helps to maintain alignment thereof throughout the protract-retract operation. The bevel of seat (64) is made possible by the extra hub diameter created by teeth (60). It will be seen that there is now provided a full uniform 360° contact between ratchet and the plunger teeth, except when the teeth engage on their tapered sides to initiate rotation. When the circular movement ceases, the 360° contact is resumed. The added contact between the auxiliary ratchet teeth and the plunger teeth also frees the plunger from the ratchet to permit movement of the ratchet on the cap teeth, without jamming with the plunger teeth.

It would be appreciated that the protract-retract type mechanism as described above may be suitably modified for use in the context of a lockable trigger mechanism by configuring the housing of the trigger mechanism with teeth and slots in an inner surface of the housing so as to take the place of the pen cap (10). The actuator of the trigger mechanism is operably coupled to the ratchet inside of the housing, for instance by seating one end of the actuator upon the ratchet so as to take the place of the pen cartridge (14). Furthermore, the exposed push button (32) of the plunger (30) would be substituted with a spring loaded-trigger that is operable by the user's finger to depress the plunger (30) relative to the ratchet.

Although the exemplary ballpoint pen protract-retract type mechanism described herein has referred to the mechanism of U.S. Pat. No. 3,288,155 for ease of understanding the principle of operation, it would be understood by persons skilled in the art that any other protract-retract type mechanism may also be utilised in embodiments of the present invention to effect locking of the trigger mechanism actuator in the ON and OFF positions.

In view of the above, it will be apparent that embodiments of the present invention herein described may assist in providing at least one of the following advantages:

(a) a faster and easier to use lockable trigger mechanism may be provided by virtue of its one-hand operation and automatic locking/unlocking operability;

(b) a safer to use lockable trigger mechanism may be provided by virtue of its one-hand operation as this obviates the need for the user's gripping/support hand to manually operate a latch member as in the case of conventional mechanisms. Also, the user may easily and quickly effect locking and unlocking of the trigger mechanism at a desired speed setting with one hand simply by squeezing the trigger in one linear motion thus obviating the need for awkward and unnatural movement of an external latch member in a multiple directions by the user's gripping/support hand;

(c) a biasing member (e.g. a return spring) of the actuator may be conveniently utilised to serve a dual-function as the biasing member of the locking mechanism. Consequently, this results in a more compact and simplified integrated trigger and locking mechanism that may be neatly accommodated within a single housing. This also reduces the number of component parts in the integrated trigger and locking mechanism and alleviates overall manufacturing costs.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A lockable trigger mechanism for an electrical device, comprising:

a housing;

a trigger configured for biased movement relative to the housing;

an actuator movably mounted to the housing such that, responsive to operation of the trigger, is movable along a movement axis from an OFF position in a direction inwardly of an opening in the housing towards an ON position, and movable along the movement axis from the ON position in a direction outwardly of the opening in the housing towards the OFF position;

an electrical switch unit mounted to the housing configured for activation in response to movement of the actuator along the movement axis between its ON and OFF positions to close and open an electrical circuit of the electrical device respectively; and a locking mechanism comprising a first locking member, a second locking member and a biasing member configured for biasing movement of the first locking member relative to the second locking member;

wherein, responsive to the actuator being moved in a direction inwardly of the housing along the movement axis from its OFF position into its ON position, the first locking member is moved relative to the second locking member into engagement with a first shape contour of said second locking member and said first locking member is held in engagement with the first shape contour of said second locking member by the biasing member urging the first and second locking members together whereby the engagement of the first locking member with the first shape contour of the second locking member is configured to restrict movement of the actuator in a direction outwardly of the housing along the movement axis from the ON position to its OFF position, and thereafter, responsive to the actuator being moved further in a direction inwardly of the housing along the movement axis, the first locking member is moved out of engagement with the first shape contour of the second locking member and along a second shape contour of the second locking member whereby the movement of the first locking member along the second shape contour of the second locking member is configured to allow the actuator to be urged in a direction outwardly of the housing along the movement axis in to its OFF position; and wherein, the first locking member includes a track disposed in a surface of the actuator, said track being formed so as to project inwardly of the actuator surface in a direction substantially perpendicularly to the direction of the movement axis of the actuator, the second locking member including a spring-loaded guide pin mounted on an inner surface of the housing, said guide pin being configured to extend inwardly of the housing from the inner surface of the housing in a direction substantially perpendicularly to the movement axis of the actuator and inwardly of the track, whereby responsive to the movement of the actuator inwardly and outwardly of the housing the guide pin is configured to slidably traverse the track.

2. A lockable trigger mechanism as claimed in claim 1 wherein the biasing member includes an elastic member.

3. A lockable trigger mechanism as claimed in claim 1 wherein the elastic member includes a coil spring.

4. A lockable trigger mechanism as claimed in claim 1 wherein the biasing member of the locking mechanism is configured for movement in substantially a same direction as the biasing member of the actuator.

5. A lockable trigger mechanism as claimed in claim 1 wherein the biasing member of the locking member is configured to function a dual-purpose as the biasing member of the actuator.

6. A lockable trigger mechanism as claimed in claim 5 wherein the biasing member of the locking member includes a return spring of the actuator.

7. A lockable trigger mechanism as claimed in claim 1 wherein the actuator is configured to move along a linear axis inwardly and outwardly of the housing via the opening between its ON and OFF positions.

8. A lockable trigger mechanism as claimed in claim 1 wherein, when the actuator is moved in a direction inwardly of the housing along the movement axis from its OFF position into its ON position and the first locking member is moved relative to the second locking member into engagement with the first shape contour of said second locking member, the electrical device is configured to operate at a maximum speed of a plurality of possible operational speeds of the electrical device.

9. A lockable trigger mechanism as claimed in claim 1 wherein, when the actuator is moved in a direction inwardly of the housing along the movement axis from its OFF position into its ON position and the first locking member is moved relative to the second locking member into engagement with the first shape contour of said second locking member, the ON position may correspond to any one of a plurality of possible operational speeds of the electrical device.

10. An electrical device including a lockable trigger mechanism in accordance with claim 1.

* * * * *